US008022579B2

(12) United States Patent
Groff et al.

(10) Patent No.: US 8,022,579 B2
(45) Date of Patent: Sep. 20, 2011

(54) BROWNOUT SOLUTION FOR ELECTROMECHANICAL AUTOMATIC TRANSFER SWITCH

(75) Inventors: Steven Mark Groff, Tucson, AZ (US); Trung Le, Tucson, AZ (US)

(73) Assignee: International Business Machines Corporation, Armonk, NY (US)

( * ) Notice: Subject to any disclaimer, the term of this patent is extended or adjusted under 35 U.S.C. 154(b) by 446 days.

(21) Appl. No.: 12/189,597

(22) Filed: Aug. 11, 2008

(65) Prior Publication Data

US 2010/0033274 A1 Feb. 11, 2010

(51) Int. Cl.
*H01H 47/02* (2006.01)

(52) U.S. Cl. ..... 307/130; 361/170

(58) Field of Classification Search ..... 307/125, 307/130; 361/92, 90, 88, 91.2, 93.1, 93.5–93.7, 361/139, 160, 170, 190
See application file for complete search history.

(56) References Cited

U.S. PATENT DOCUMENTS

| | | | | |
|---|---|---|---|---|
| 2,104,603 | A | 1/1938 | Agnew et al. | |
| 2,128,324 | A | 8/1938 | Root | |
| 2,468,634 | A | 4/1949 | Lexa | |
| 3,395,288 | A * | 7/1968 | Von Brimer | 307/10.7 |
| 3,474,296 | A * | 10/1969 | Rickey | 361/92 |
| 4,025,823 | A * | 5/1977 | Lang et al. | 361/111 |
| 4,110,807 | A * | 8/1978 | Neuhouser | 361/42 |
| 5,814,979 | A * | 9/1998 | Grimm | 323/284 |
| 5,856,905 | A | 1/1999 | Eckel et al. | |
| 6,587,325 | B1 * | 7/2003 | Volz | 361/155 |
| 2008/0054722 | A1 | 3/2008 | Phelps et al. | |
| 2008/0100248 | A1 | 5/2008 | Filippenko | |

OTHER PUBLICATIONS

International Search Report for counterpart Application No. PCT/EP2009/060252, dated Nov. 12, 2009.

* cited by examiner

*Primary Examiner* — Albert W Paladini
(74) *Attorney, Agent, or Firm* — Griffiths & Seaton PLLC

(57) ABSTRACT

A circuit for dynamically increasing the drop-out voltage of an electromechanical automatic transfer switch (ATS) into a brownout voltage range is provided. The automatic transfer switch includes a first input, a first coil connected to the first input, and a first, normally-open auxiliary contact in magnetic communication with the first coil. The circuit includes a first resistor adapted to connect to the first, normally-open auxiliary contact, and a first transformer having a primary winding connected to the first resistor, and a secondary winding adapted to connect to the first coil. An operating voltage across the first coil is reduced a proportional amount by a secondary voltage across the secondary winding when the first, normally-open auxiliary contact is closed.

24 Claims, 3 Drawing Sheets

BROWNOUT SOLUTION FOR ELECTROMECHANICAL AUTOMATIC TRANSFER SWITCH

BACKGROUND OF THE INVENTION

1. Field of the Invention

The present invention relates in general to the mechanism for supplying power to electronic devices, and more particularly, but not exclusively, to a fully electromechanical automatic transfer switch having a mechanism for accommodating brownout conditions.

2. Description of the Related Art

Transfer switches allow switching from a primary power source to a secondary or tertiary power source and are employed in some electrical power distribution systems. Transfer switches may be seen where emergency power generators are used to provide back up power from the utility source. The transfer switch allows switching from utility power to emergency generator power. The switch is a manual switch, an automatic switch, or a combination of both. During a power outage, transfer switches isolate the emergency circuits from the utility line, allowing for efficient operation of the generator without backfeeding into the utility. An automatic transfer switch (ATS) is a type of transfer switch that automatically connects one of two alternating current (AC) line sources to an electrical load, usually the better of the two sources.

In virtually every power setting, "brownouts," or conditions where lower voltage than normal is supplied to the load, may present themselves. ATS devices generally use microcontroller-based "smart" electronic control circuits to accommodate this condition. Supporting the microcontroller, however, requires voltage sensors, signal condition equipment, power supplies, coil drive circuitry, and control firmware. These additional requirements add to system cost and complexity, and present several potential points of failure.

SUMMARY OF THE INVENTION

In light of the foregoing, a need exists for an automatic transfer switch (ATS) design that accommodates brownout conditions and continues to function properly, yet reduces system cost, complexity, and points of failure.

Accordingly, in one embodiment, by way of example only, a circuit for dynamically increasing the drop-out voltage of an electromechanical automatic transfer switch (ATS) into a brownout voltage range is provided. The automatic transfer switch includes a first input, a first coil connected to the first input, and a first, normally-open auxiliary contact in magnetic communication with the first coil. The circuit includes a first resistor adapted to connect to the first, normally-open auxiliary contact, and a first transformer having a primary winding connected to the first resistor, and a secondary winding adapted to connect to the first coil. An operating voltage across the first coil is reduced a proportional amount by a secondary voltage across the secondary winding when the first, normally-open auxiliary contact is closed.

In an additional embodiment, again by way of example only, an electromechanical automatic transfer switch (ATS) having a circuit for dynamically increasing the drop-out voltage into a brownout voltage range is provided. The ATS includes a first input. A first coil is connected to the first input. A first, normally-open auxiliary contact is in magnetic communication with the first coil. A first resistor is connected to the first, normally-open auxiliary contact. A first transformer has a primary winding connected to the first resistor, and a secondary winding connected to the first coil. An operating voltage across the first coil is reduced by a proportional amount when the first, normally-open auxiliary contact is closed.

In an additional embodiment, again by way of example only, a method of manufacturing a circuit for dynamically increasing the drop-out voltage of an electromechanical automatic transfer switch (ATS) into a brownout voltage range is provided. The automatic transfer switch includes a first input, a first coil connected to the first input, and a first, normally-open auxiliary contact in magnetic communication with the first coil. The method of manufacturing the circuit includes providing a first resistor adapted to connect to the first, normally-open auxiliary contact, and providing a first transformer having a primary winding connected to the first resistor, and a secondary winding adapted to connect to the first coil. An operating voltage across the first coil is reduced a proportional amount by a secondary voltage across the secondary winding when the first, normally-open auxiliary contact is closed.

In still another embodiment, again by way of example only, a method of manufacturing an electromechanical automatic transfer switch (ATS) having a circuit for dynamically increasing the drop-out voltage into a brownout voltage range is provided. The method includes providing a first input, providing a first coil connected to the first input, providing a first, normally-open auxiliary contact in magnetic communication with the first coil, providing a first resistor connected to the first, normally-open auxiliary contact, and providing a first transformer having a primary winding connected to the first resistor, and a secondary winding connected to the first coil. An operating voltage across the first coil is reduced by a proportional amount when the first, normally-open auxiliary contact is closed.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
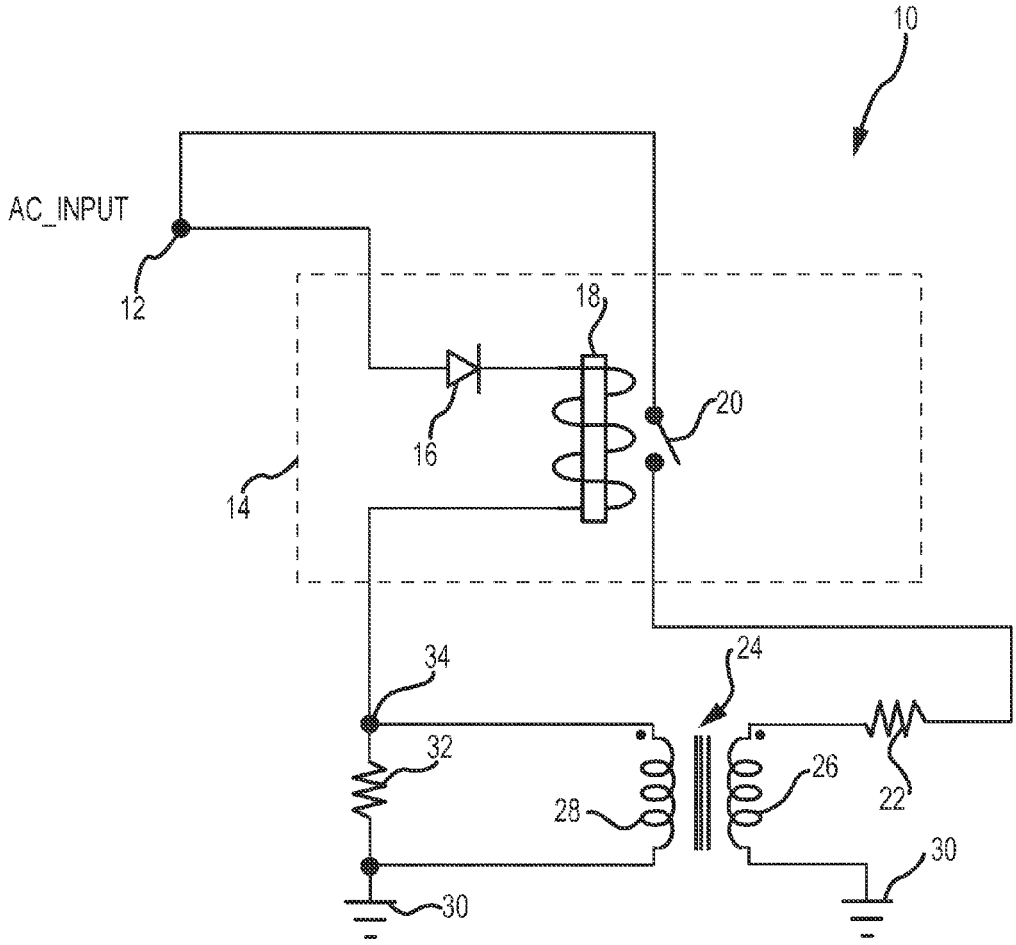
FIG. 1 is a schematic diagram of an exemplary portion of an automatic transfer switch (ATS) having a transformer circuit to accommodate brownout conditions.

As described previously, an automatic transfer switch (ATS) is a device that connects one of two alternating current (AC) line sources to a load, usually the better of the two sources. The electromechanical ATS is normally comprised of two contactors, each actuated by a coil. A contactor is a type of relay rated to switch high power AC or DC current.

As mentioned previously, a brownout is a condition of lower than normal power line voltage being supplied by local utility or generating equipment. This condition may be short term (minutes to hours) or long term (½ day or more). A power line voltage reduction greater than 10% of nominal is usually considered a brownout. In many cases, electronic equipment cannot be expected to function during brownout conditions.

A contactor coil voltage must typically rise to 85% of the rated voltage to guarantee the contactor will close or make the electrical circuit. This is referred to as the "pick-up voltage" in the contactor specifications. After the contactor is energized, the voltage must typically fall to 60% of the rated voltage to guarantee the contactor will open or break the electrical circuit. This is referred to as the "drop-out voltage" in the contactor specifications.

During a brownout, the voltage will fall out of tolerance, but not low enough to reach the drop out threshold of the contactor coil. As long as the voltage stays in brownout, the contactor will not drop out. In an ATS, the contactor will not transfer to the other AC line source, even if it is in tolerance. The conventional solution to this problem has been to electronically control the transfer in the brownout voltage range, as described previously. This requires a smart electronic control circuit to drive the contactor coils. This provides repeatable operation at any line voltage, but is a more complex solution. The most common solution involves a microcontroller-based or other smart electronic control circuit to drive low voltage DC coils. Supporting the microcontroller requires voltage sensors, signal conditioning, power supplies, coil drive transistors, and control firmware. This solution is much more complex to implement. The complexity increases the cost and lowers the reliability.

In contrast to the conventional solution, the illustrated embodiments dynamically and automatically increase the drop-out voltage of any standard contactor into the brownout range, allowing the ATS to transfer connectivity to the other AC line. The illustrated embodiments below implement a fully electromechanical automatic transfer switch (ATS) with an integrated capability to accommodate brownout conditions. This capability is provided by an isolation transformer or autotransformer circuit connected to the Normally-Open (N.O) auxiliary contacts and contactor coil terminals as will be described, following. The transformer circuit operates to reduce the operating voltage across the contactor coil by the voltage across the secondary winding of the transformer by a proportional amount. This effectively increases the drop-out voltage of the contactor into the brownout range. The illustrated embodiments provide a simple, fully electromechanical solution with lower cost and fewer points of failure, thus increasing reliability and repeatability.

The illustrated embodiments allow transfer of the ATS contactor at higher AC line voltages than the specified drop-out threshold of the driving coil. The drop-out voltage is increased, but at the same time, the pick-up voltage is unchanged and the hysteresis between rising pick-up voltage and the falling drop-out voltage is retained.

Turning to FIG. 1, an exemplary portion 10 of an ATS is illustrated. Portion 10 includes an AC input 12 feeding an input voltage into relay 14. Relay 14 includes a diode 16 representative of rectification, such as full wave or half wave rectification (rectifier). Relay 14 also includes a contactor coil 18 in magnetic communication with a normally-open auxiliary (AUX) contact (switch) 20. As one skilled in the art will appreciate, when the contactor coil 18 is energized, the normally-open contact 20 will close. AC input 12 is connected to both diode 16 and a terminal of contact 20 as shown.

An transformer circuit is shown connected to the contactor coil 18 and contact 20. In the depicted embodiment, the transformer circuit includes two resistors 22 and 32, and a transformer 24 (here represented as an ideal transformer). On the primary side, resistor 22 is connected between the primary winding 26 of transformer 24, and a terminal of the contact 20. Primary winding 26 is also connected to ground 30. On the secondary side, secondary winding 28 is coupled in parallel with resistor 32. The negative side of contactor coil 18 is connected to the resistor 32 and secondary winding 28 at node 34. Resistor 32 is also connected to ground 30 as shown. These resistors may be physical components or the intrinsic resistances of the transformer windings.

When the contactor coil 18 is de-energized, the normally-open auxiliary contact 20 is open, and no current flows through the transformer 24 primary. The full AC input voltage is applied to the contactor coil 18, minus the small IR (voltage) drop in the transformer 24 secondary. After the coil 18 is energized and the contactor picks-up, the normally-open auxiliary contact 20 will close. The voltage on the coil is now reduced by the transformer induced secondary voltage. This allows the contactor to drop-out in the brown-out voltage range, and the ATS to transfer to the other input line.

As the skilled artisan will appreciate, the transformer secondary voltage may be selectively varied, thereby varying the amount of voltage on the coil is reduced. For example, the number of turns of the primary and/or secondary windings may be varied to change the step-down ratio.

Figure 2:
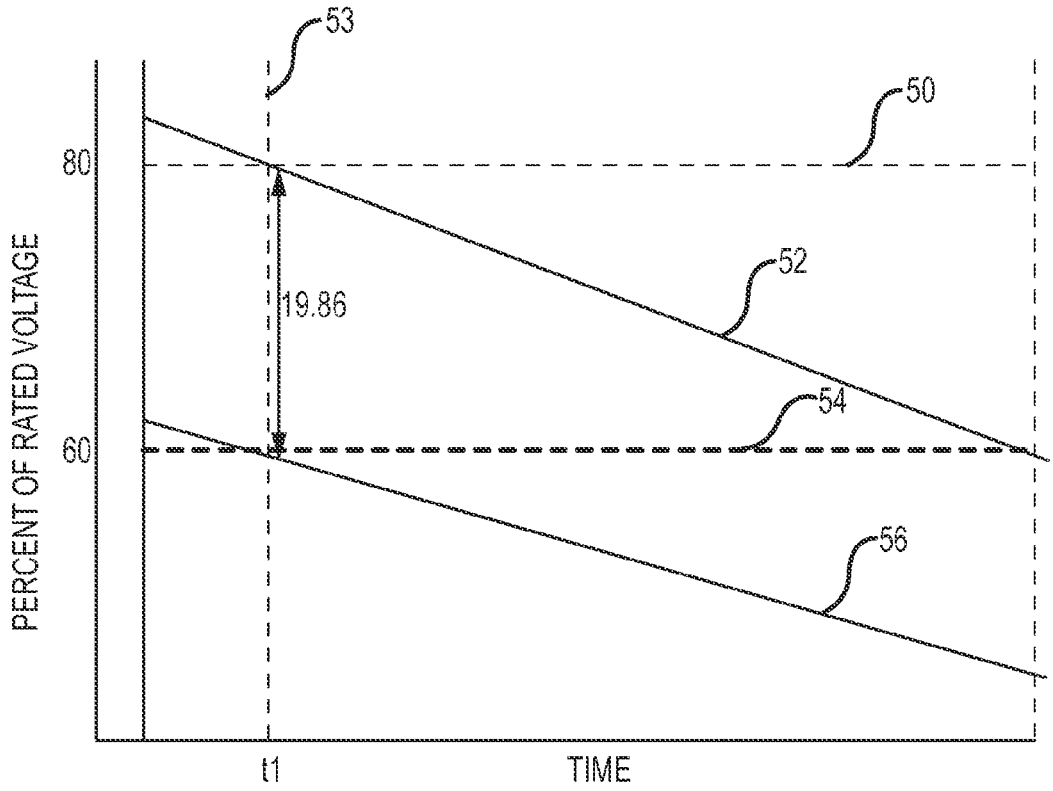
FIG. 2 is an exemplary graph comparing a percentage of rated voltage versus input voltage in a brownout range.

Consider the following example. A step-down transformer 24 is implemented, having a ratio of 4:1. In this case, the voltage across coil 18 will reach the 60% guaranteed drop-out voltage when the AC input seen at input 12 has only fallen to 79.9% of rated voltage. FIG. 2 graphically displays such a result across a depicted brownout range. The percentage of rated voltage is shown along the Y-axis, while elapsed time is shown along the X-axis. Line 52 represents the AC input voltage, falling from 100% of rated voltage over time. Dotted line 50 represents 79.9% of rated voltage, while dotted line 54 represents the 60% of rated voltage threshold previously described. The area between dotted line 54 and dotted line 50 represents a typical brownout voltage range. At time $t_1$ (represented by dotted line 53), the AC input voltage 52 has entered the brownout range at approximately 80% of rated voltage. Meanwhile, however, the voltage across the coil has been reduced by approximately 19.86%, so that as time progresses slightly further, the drop-out voltage for the contactor is achieved, and the contactor drops out as a result.

Figure 3:
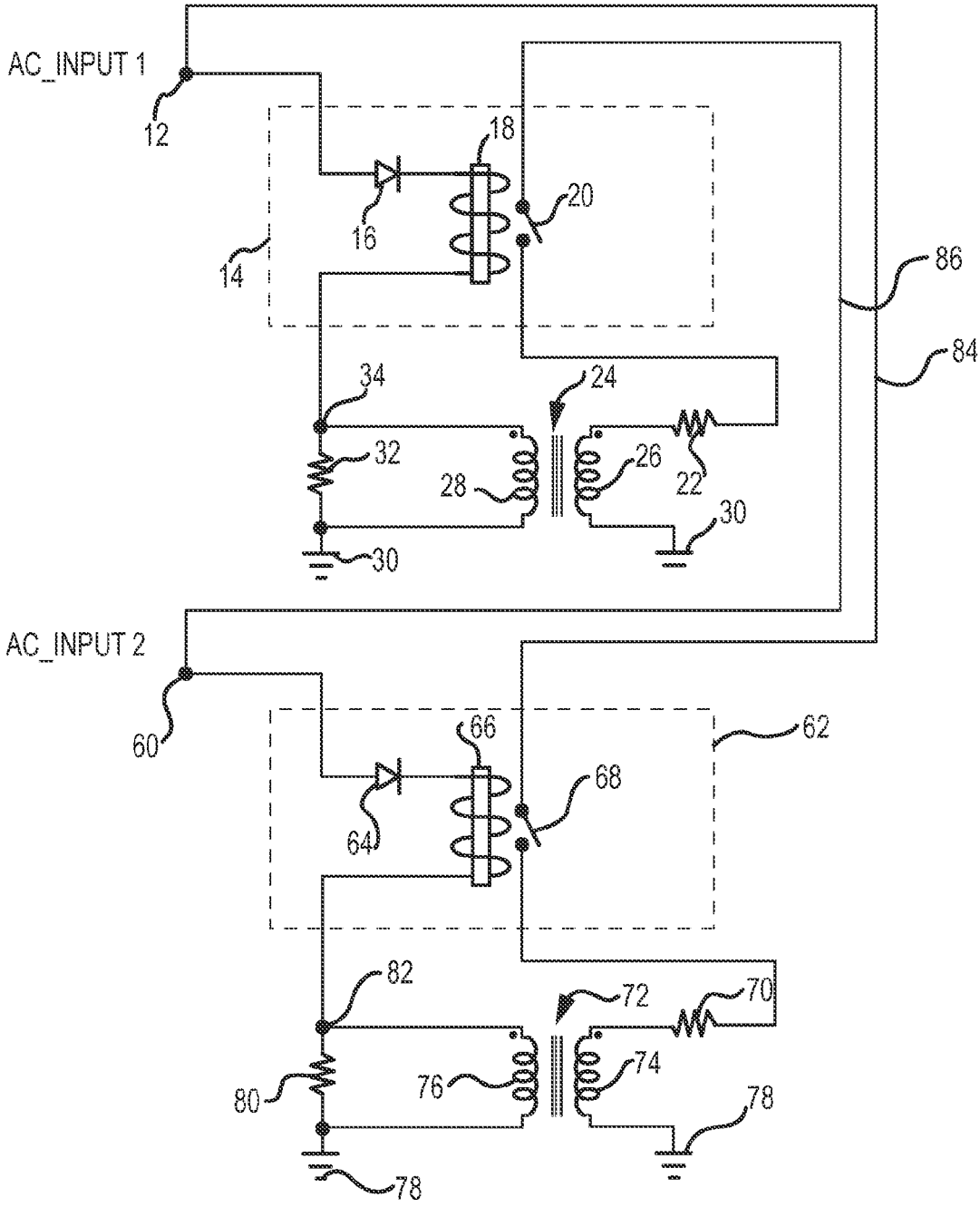
FIG. 3 is a schematic diagram of an additional exemplary portion of an ATS, showing two cross-connected inputs, two relay devices, and two connected transformer circuits.

Turning now to FIG. 3, the portion 10 of ATS shown in FIG. 1 is implemented in an ATS circuit by using two contactors and two AC line sources. Here as before, a first relay includes coil 18 and normally-open auxiliary contact 20, and the transformer circuit including resistors 22, and 32, and transformer 24, interconnected as previously described in FIG. 1. In addition, however, a second relay 62 is shown connected to a second AC input 60. The relay 62 includes an additional contactor having an additional coil 66 and normally-open auxiliary contact 68, as well as rectification 64. An additional transformer circuit includes resistors 70 and 80, transformer 72 (including primary winding 74 and secondary winding 76, as well as ground 78. The additional relay 62 and transformer components are interconnected in similar fashion to the relay 14 and first transformer circuit.

In the depicted embodiment, AC inputs 12 and 60 are cross-connected to the normally-open auxiliary contact of the opposite line's contactor. AC input 12 is connected to a terminal of contact 68 via wire 84, and AC input 60 is connected to contact 20 via line 86. The cross connected AC inputs 12 and 60 add additional repeatability to the modified drop-out voltage threshold. The two input line sources are independent and assumed to be in tolerance. When an input line falls in to the brown-out range, the other AC line source is still in tolerance. The other AC line voltage is used to shift the contactors drop-out voltage. The in-tolerance source generates the shift, not the falling brown-out voltage. When the other voltage is zero, there is no shift of the drop-out voltage, and the line will stay connected down to the specified drop-out voltage.

The advantages of the foregoing embodiments are provided by their simplicity. The illustrated embodiments may be implemented with a fewer components. Further, the components are all passive and electromagnetic. The illustrated embodiments are naturally reliable designs with a high mean time between failures (MTBF). The lower cost and higher efficiency also result from the simple circuit.

While one or more embodiments of the present invention have been illustrated in detail, the skilled artisan will appreciate that modifications and adaptations to those embodiments may be made without departing from the scope of the present invention as set forth in the following claims.

What is claimed is:

1. A circuit for dynamically increasing the drop-out voltage of an electromechanical automatic transfer switch (ATS) into a brownout voltage range, the automatic transfer switch including a first input, a first coil connected to the first input, and a first, normally-open auxiliary contact in magnetic communication with the first coil, the circuit comprising:

a first resistor adapted to connect to the first, normally-open auxiliary contact; and a first transformer having a primary winding connected to the first resistor, and a secondary winding adapted to connect to the first coil, wherein an operating voltage across the first coil is reduced a proportional amount by a secondary voltage across the secondary winding when the first, normally-open auxiliary contact is closed.

2. The circuit of claim 1, further including a second resistor connected to the secondary winding.

3. The circuit of claim 1, wherein the proportional amount is selectively adjustable by varying a turns ratio of the first transformer.

4. The circuit of claim 1, wherein the ATS further includes a second input, a second coil connected to the second input, and a second, normally-open auxiliary contact in magnetic communication with the second coil, and further including:

a second resistor adapted to connect to the second, normally-open auxiliary contact, and a second transformer having a primary winding connected to the second resistor, and a secondary winding adapted to connect to the second coil, wherein an additional operating voltage across the second coil is reduced an additional proportional amount by an additional secondary voltage across the secondary winding when the second, normally-open auxiliary contact is closed.

5. The circuit of claim 4, further including a third resistor connected to the secondary winding of the first transformer, and a fourth resistor connected to the secondary winding of the second transformer.

6. The circuit of claim 4, wherein the first, normally-open auxiliary contact is connected to the second input, and the second, normally-open auxiliary contact is connected to the first input.

7. An electromechanical automatic transfer switch (ATS) having a circuit for dynamically increasing the drop-out voltage into a brownout voltage range, comprising:

a first input;

a first coil connected to the first input;

a first, normally-open auxiliary contact in magnetic communication with the first coil;

a first resistor connected to the first, normally-open auxiliary contact; and a first transformer having a primary winding connected to the first resistor, and a secondary winding connected to the first coil, wherein an operating voltage across the first coil is reduced by a proportional amount when the first, normally-open auxiliary contact is closed.

8. The ATS of claim 7, further including a rectifier connected between the first coil and the first input.

9. The ATS of claim 7, wherein the proportional amount is selectively adjustable by varying a turns ratio of the first transformer.

10. The ATS of claim 7, further including:

a second input, a second coil connected to the second input, a second, normally-open auxiliary contact in magnetic communication with the second coil, a second resistor connected to the second, normally open auxiliary contact, and a second transformer having a primary winding connected to the second resistor, and a secondary winding connected to the second coil, wherein an additional operating voltage across the second coil is reduced an additional proportional amount by an additional secondary voltage across the secondary winding when the second, normally-open auxiliary contact is closed.

11. The ATS of claim 10, further including a third resistor connected to the secondary winding of the first transformer, and a fourth resistor connected to the secondary winding of the second transformer.

12. The ATS of claim 10, wherein the first, normally-open auxiliary contact is connected to the second input, and the second, normally-open auxiliary contact is connected to the first input.

13. A method of manufacturing a circuit for dynamically increasing the drop-out voltage of an electromechanical automatic transfer switch (ATS) into a brownout voltage range, the automatic transfer switch including a first input, a first coil connected to the first input, and a first, normally-open auxiliary contact in magnetic communication with the first coil, the circuit comprising:

providing a first resistor adapted to connect to the first, normally-open auxiliary contact; and providing a first transformer having a primary winding connected to the first resistor, and a secondary winding adapted to connect to the first coil, wherein an operating voltage across the first coil is reduced a proportional amount by a secondary voltage across the secondary winding when the first, normally-open auxiliary contact is closed.

14. The method of manufacture of claim 13, further including providing a second resistor connected to the secondary winding.

15. The method of manufacture of claim 13, further including selecting the proportional amount by selecting a turns ratio for the first transformer.

16. The method of manufacture of claim 13, wherein the ATS further includes a second input, a second coil connected to the second input, and a second, normally-open auxiliary contact in magnetic communication with the second coil, and further including:

providing a second resistor adapted to connect to the second, normally-open auxiliary contact, and providing a second transformer having a primary winding connected to the second resistor, and a secondary winding adapted to connect to the second coil, wherein an additional operating voltage across the second coil is reduced an additional proportional amount by an additional secondary voltage across the secondary winding when the second, normally-open auxiliary contact is closed.

17. The method of manufacture of claim 16, further including providing a third resistor connected to the secondary winding of the first transformer, and providing a fourth resistor connected to the secondary winding of the second transformer.

18. The method of manufacture of claim 16, further including connecting the first, normally-open auxiliary contact to the second input, and connecting the second, normally-open auxiliary contact to the first input.

19. A method of manufacturing an electromechanical automatic transfer switch (ATS) having a circuit for dynamically increasing the drop-out voltage into a brownout voltage range, comprising:

providing a first input;

providing a first coil connected to the first input;

providing a first, normally-open auxiliary contact in magnetic communication with the first coil;

providing a first resistor connected to the first, normally-open auxiliary contact; and providing a first transformer having a primary winding connected to the first resistor, and a secondary winding connected to the first coil, wherein an operating voltage across the first coil is reduced by a proportional amount when the first, normally-open auxiliary contact is closed.

20. The method of manufacture of claim 19, further including a providing rectifier connected between the first coil and the first input.

21. The method of manufacture of claim 19, further including selecting the proportional amount by selecting a turns ratio for the first transformer.

22. The method of manufacture of claim 19, further including:

providing a second input, providing a second coil connected to the second input, providing a second, normally-open auxiliary contact in magnetic communication with the second coil, providing a second resistor connected to the second, normally open auxiliary contact, and providing a second transformer having a primary winding connected to the second resistor, and a secondary winding connected to the second coil, wherein an additional operating voltage across the second coil is reduced an additional proportional amount by an additional secondary voltage across the secondary winding when the second, normally-open auxiliary contact is closed.

23. The method of manufacture of claim 22, further including providing a third resistor connected to the secondary winding of the first transformer, and providing a fourth resistor connected to the secondary winding of the second transformer.

24. The method of manufacture of claim 22, further including connecting the first, normally-open auxiliary contact to the second input, and connecting the second, normally-open auxiliary contact to the first input.

* * * * *